US007583037B2

(12) United States Patent
Bourke et al.

(10) Patent No.: US 7,583,037 B2
(45) Date of Patent: Sep. 1, 2009

(54) MOBILE STORAGE UNIT WITH HOLDING BRAKE AND SINGLE STATUS LINE FOR LOAD AND DRIVE DETECTION

(75) Inventors: Brian P. Bourke, Jefferson, WI (US); Steven M. Lehmann, Fort Atkinson, WI (US); Brian R. Nemec, Delavan, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 356 days.

(21) Appl. No.: 11/426,150

(22) Filed: Jun. 23, 2006

(65) Prior Publication Data

US 2007/0296265 A1 Dec. 27, 2007

(51) Int. Cl.
*H02P 1/54* (2006.01)

(52) U.S. Cl. ..... 318/34; 318/568.2; 318/63; 318/53; 318/38; 312/198; 312/199; 312/201

(58) Field of Classification Search ..... 318/372, 318/568.2, 34, 38, 53, 63, 362; 104/106; 301/5.1, 6.1, 111.01, 126; 312/198, 199, 312/200, 201

See application file for complete search history.

(56) References Cited

U.S. PATENT DOCUMENTS 3,957,323 A * 5/1976 Tucker et al. ..... 312/198
4,017,131 A 4/1977 Camenisch
4,087,852 A 5/1978 Campbell et al.
4,290,000 A 9/1981 Sun
4,437,711 A * 3/1984 Dahnert ..... 312/201
4,558,389 A 12/1985 Black, Jr. et al.
4,616,888 A 10/1986 Peterman
4,616,889 A 10/1986 Peterman
4,628,397 A 12/1986 Gareis et al.
4,700,304 A 10/1987 Byrne et al.
4,703,388 A 10/1987 Ruhnau
4,733,923 A 3/1988 Dahnert
4,743,078 A * 5/1988 Dahnert ..... 312/201
4,745,516 A 5/1988 Griffin
4,914,419 A 4/1990 Bragenzer et al.
4,945,297 A 7/1990 Coustre
5,119,312 A 6/1992 Groger et al.
5,160,190 A * 11/1992 Farrell et al. ..... 312/201
5,193,696 A 3/1993 Price, Jr. et al.
5,205,619 A 4/1993 Holst et al.
5,265,739 A 11/1993 Price, Jr. et al.
5,285,139 A 2/1994 Ogasawara
5,304,935 A 4/1994 Rathke et al.

(Continued)

*Primary Examiner*—Bentsu Ro
*Assistant Examiner*—Thai Dinh
(74) *Attorney, Agent, or Firm*—Andrus, Sceales, Starke & Sawall, LLP

(57) ABSTRACT

The present invention is a mobile storage unit including an electric motor operably connected to wheels movably supporting the unit, and a motor brake operably connected to the electric motor. A shaft is rotatably mounted to the unit and supports the wheels on which the unit moves, and is engaged with an electric motor. The electric motor operates to rotate the shaft and the wheels to move the unit in the desired direction. Upon deactivation of the motor, the motor brake, which is also engaged with the shaft, operates to prevent any further rotation of the shaft to maintain the mobile storage unit in a specified location regardless of deflection of the surface on which the storage unit is positioned.

13 Claims, 3 Drawing Sheets

U.S. PATENT DOCUMENTS 5,341,944 A 8/1994 Latino
5,406,180 A * 4/1995 Feller, Jr. ..... 318/372
5,417,486 A 5/1995 Manlove
5,430,438 A 7/1995 Joos et al.
RE35,047 E 10/1995 Potter
5,510,950 A 4/1996 Bills et al.
5,515,278 A 5/1996 Niggemann et al.
5,569,910 A * 10/1996 Griesemer ..... 250/221
5,739,654 A 4/1998 Doran et al.
5,803,554 A 9/1998 Maruta et al.
5,833,296 A 11/1998 Schneider
5,850,082 A 12/1998 Eaton et al.
5,886,510 A 3/1999 Crespi et al.
5,920,452 A 7/1999 Sullivan
5,938,047 A 8/1999 Ellis et al.
6,040,665 A 3/2000 Shirai et al.
6,157,153 A 12/2000 Uegami et al.
6,362,599 B1 3/2002 Turner et al.
6,448,727 B1 9/2002 Rotterhusen
6,595,332 B1 7/2003 Pennington
6,633,475 B2 10/2003 Thiele
6,737,823 B2 5/2004 Reed et al.
6,805,094 B2 10/2004 Hashimoto et al.
6,883,123 B2 4/2005 Hashimoto et al.
6,885,160 B2 4/2005 Takeuchi
7,032,762 B2 * 4/2006 Miyazaki et al. ..... 211/162
7,456,594 B2 * 11/2008 Potter et al. ..... 318/377
2003/0067253 A1 4/2003 Kuo

* cited by examiner

MOBILE STORAGE UNIT WITH HOLDING BRAKE AND SINGLE STATUS LINE FOR LOAD AND DRIVE DETECTION

FIELD OF THE INVENTION

The present invention relates to a mobile storage unit powered by an electric motor, and more specifically to a motor-powered storage unit that includes a holding brake to prevent the storage unit from drifting when the electric motor is not powered, and a monitoring arrangement for the motor of the storage unit.

BACKGROUND OF THE INVENTION

In a large number of mobile storage systems, the mobile storage units are selectively movable along rails to which the units are mounted. The units can be moved on the rails in a manually operated manner, or through the use of a motor, such as an electric motor operably connected to wheels that move the storage unit along the rails. In such motor-powered units, the user selectively actuates a switch to operate the motor, and a drive system between the motor output shaft and the wheels is operable to rotate the wheels in order to move the unit along the rails in the desired direction.

When a storage system including a number of mobile units is employed, once the units are loaded, the floor or other surface underlying the rails tends to deflect under the weight of the storage units and the items loaded in each unit. This deflection of the floor or other underlying surface causes deflection of the rails, which creates a curved rail profile defining a lowermost point between the opposite ends of the rails. As a consequence, the wheels of each storage unit have a tendency to move along the rails under the influence of gravity toward the lowermost point of the rails. Thus, when the motor of each storage unit is not being operated to move the storage unit along the rails, the rotational tendency of the wheels causes the unit to drift from the stationary position away from the desired position toward the lowermost point of the rails caused by deflection of the floor or other underlying surface. To prevent this, a number of different locking mechanisms have been developed which engage adjacent storage units with one another and/or with stops or end panels positioned at each end of the storage system to prevent the inadvertent or unintended movement of the units in response to deflection of the rails. However, such locking mechanisms normally require a number of additional components to be integrated into each unit of the storage system, which increases the overall complexity and cost of the each unit, and for the overall mobile storage system. Furthermore, such locking mechanisms are often manually operated, and therefore require an individual to actively engage the locking mechanism in order to prevent the movement of the movement of the units with respect to one another.

Therefore, it is desirable to develop a storage system that prevents inadvertent or unintended movement of the storage units when the storage units are placed in a desired position. It is further desirable to provide a storage system that includes a number of motor-driven storage units, and which includes an automatically operated locking or braking mechanism that holds each storage unit in a desired location when the motor is not being operated to move the storage unit. The locking or braking mechanism should be automatically engageable when operation of the motor is stopped, and should have a minimum number of components to reduce cost and the facilitate incorporation into both new and existing storage units.

SUMMARY OF THE INVENTION

According to a primary aspect of the present invention, a mobile storage system includes a number of storage units that are movable along a number of rails, and each storage unit includes wheels that ride on the rails and a drive arrangement responsive to operation of an electric motor for moving the storage unit along the rails. The electric motor includes an output shaft that provides rotary power to the drive arrangement. The electric motor is operated to move the storage unit in a desired direction until the unit is located in a position as desired by an operator, to create an aisle between a pair of storage units, in a manner as is known. The storage unit includes an automatic locking or braking mechanism, to positively maintain the storage unit in the desired position when driving movement of the storage unit is stopped by stopping operation of the electric motor. The automatic locking or braking mechanism is in the form of a motor brake that is selectively engageable with the motor output shaft to selectively prevent the motor output shaft from rotating when operation of the motor is stopped, to thereby prevent rotation of the wheels and to thus maintain the storage unit in the desired position at which the storage unit is located when operation of the motor is stopped. When the storage unit is to be moved from its location, the motor brake is automatically disengaged from the motor output shaft prior to operation of the motor, to allow the motor output shaft to freely rotate and to thereby move the storage unit on the rails. The motor brake and motor are each operably connected to the main control of the storage unit, such that the operation of the motor brake is efficiently synchronized with operation of the motor in order to ensure that operation of the motor brake and the motor do not interfere with one another during use of the mobile storage system.

According to another aspect of the present invention, the motor brake is connected to a status monitor with a pair of connections that provide source and return signals indicative of operation of the motor brake. The system includes a main control board. The connection between the main control board and the motor brake runs through a motor brake and status board. The connection between the status board and the main control board is made by a single status line. The single status line provides signals to the main control board indicative of both the connection of the motor brake and the status board to a load as sensed by the motor brake and to a high side drive. By providing status signals for both the high side drive and the motor brake, through a single status line to the main control board, the construction and operation of the control system for the motor brake and electric motor of each mobile storage unit in a storage system is significantly simplified.

Numerous other features, aspects and advantages of the present invention will be made apparent from the following detailed description taken together with the drawing figures.

BRIEF DESCRIPTION OF THE DRAWINGS

The drawing figures illustrate the best mode currently contemplated for practicing the present invention.

In the drawings.

DETAILED DESCRIPTION OF THE INVENTION

Figure 1:
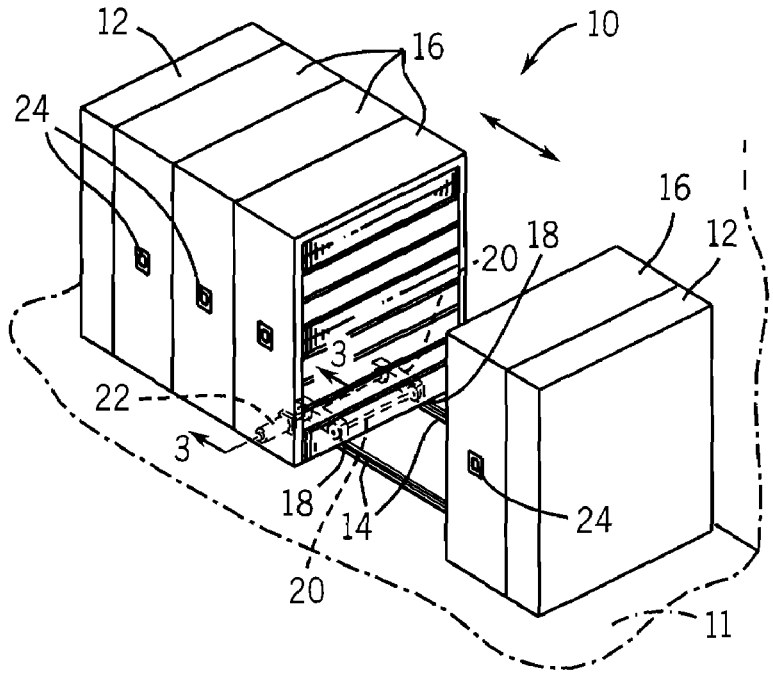
FIG. 1 is an isometric view of a mobile storage unit system incorporating the motor brake and single status line of the present invention.

With reference now to the drawing figures in which like reference numerals designate like parts throughout the disclosure, a mobile storage system is indicated generally at 10 in FIG. 1. The storage system 10 is mounted over a floor or other supporting surface 11, and includes a pair of end panels or members 12 between which extend a pair of rails 14, in a manner as is known. The rails 14 support a number of storage units 16, each of which is movable on the rails 14 via one or more wheels 18 rotatably mounted to the storage unit 16. Representatively, each wheel 18 may include a pair of flanges 19 between which rail 14 is received, to guide movement of the storage unit on the rail 14. The particular manner in which the wheels 18 are engaged with the rails 14 is known in the art.

Each set of wheels 18 on each storage unit 16 is interconnected by a transverse shaft 20, so that the wheels 18 rotate together. One of the shafts 20 is operably connected to an electric motor 22, which may be secured to a cross member 23 forming a part of the carriage of the storage unit 16. The cross member 23 may be in the form of an inverted channel member, and preferably serves to mount the wheels 18 to the carriage of storage unit 16.

Figure 3:
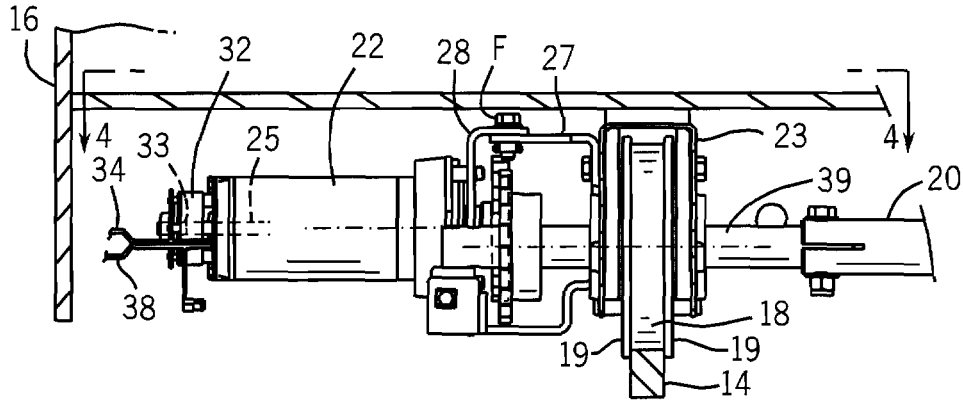
FIG. 3 is an enlarged partial section view taken along line 3-3 of FIG. 1.
Figure 4:
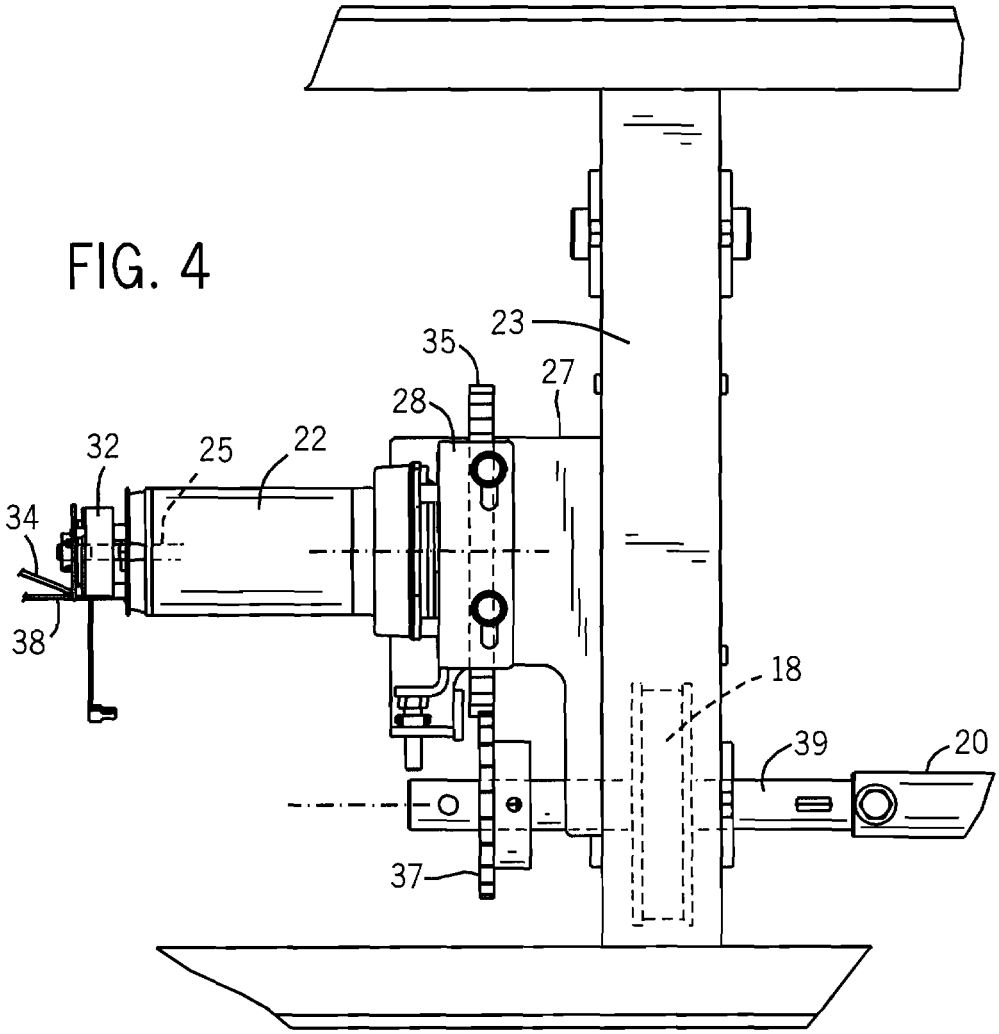
FIG. 4 is a partial section view taken along line 4-4 of FIG. 3.

As shown in FIGS. 3 and 4, mounting bracket 27 is secured to one of the vertical walls of cross member 23. Mounting bracket 27 has an inverted L-shape, and a pair of spaced apart openings are formed in the upper horizontal wall of mounting bracket 27. A motor bracket 28 is operable to mount motor 22 to mounting bracket 27. Motor bracket 28 also has an inverted L-shape, and includes an upper horizontal wall that overlaps the upper horizontal wall of mounting bracket 27. Motor 22 is secured to the vertical wall of motor bracket 28, and is oriented horizontally such that the output shaft of motor 22 extends through an opening in the vertical wall of motor bracket 28. The upper horizontal wall of motor bracket 28 includes a pair of slots, which are configured to overlie the openings in the upper horizontal wall of mounting bracket 27. A pair of fasteners F extend through the aligned openings and slots, and are employed to selectively fix motor bracket 28 to mounting bracket 27, and to thereby fix the position of motor 22.

The output shaft of motor 22 drives rotation of a drive gear 35, which in turn is engaged with a driven gear 37 mounted to an axle 39, to which shaft 20 is secured. Wheel 18 is secured to axle 39, such that operation of motor 22 results in driving rotation of wheel 18 through drive gear 35, driven gear 37 and axle 39. In this manner, the motor 22 drives one of the wheels 18 into rotation, which is transferred by shaft 20 to the other wheel 18 in the set of wheels. The other set of wheels 18 rotate synchronously with rotation of the driven wheels 18, to move the storage unit 16 in a desired direction on the rails 14.

It is also understood that the output shaft of motor 22 may be drivingly engaged with a drive shaft interconnected with wheels 18 in any other satisfactory manner, e.g. through a belt or chain drive arrangement, in a manner as is known. The motor output shaft is representatively illustrated at 25, and is rotatable in response to operation of motor 22 to provide rotary output power. The motor 22 is operated in response to actuation through an operator control panel 24 disposed on the storage unit 16, in order to move the particular storage unit 16 along the rails 14 to a desired position. When the motor 22 is not in use to rotate the output shaft 25, the output shaft 25 is free to rotate within the motor 22 and the drive shaft 20 is thus free to rotate along with wheels 18.

It is understood that the drive system as shown and described represents one embodiment of a satisfactory drive system that may be used to impart movement to storage units 16. Many other types of drive systems are known in the art, and may be used to move storage units 16 on rails 14. The present invention is not limited to the specific type of drive system used to move storage units 16 in response to operation of motor 22.

Figure 2:
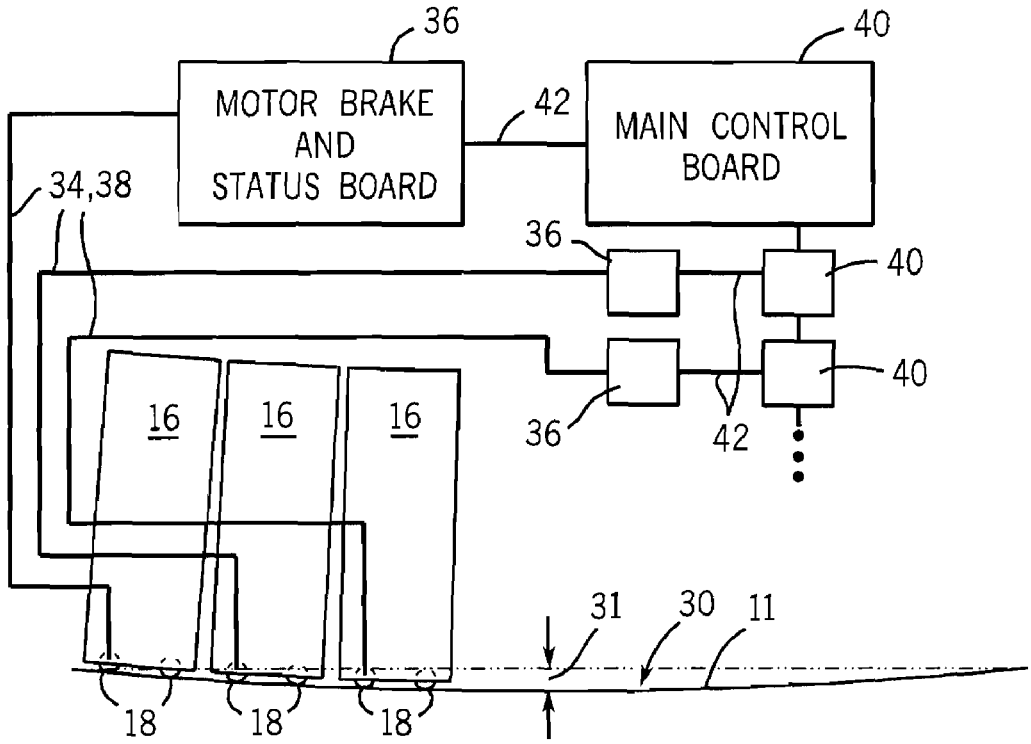
FIG. 2 is a schematic view of the mobile storage system of FIG. 1 and a control arrangement incorporated in the mobile storage system.

FIG. 2 illustrates deflection of the surface 11 to which the rails 14 are mounted, under the weight of the loaded storage units 16. The deflection of the surface 11 is shown with reference to the dotted line in FIG. 2, which illustrates a normal flat, planar orientation and attitude of surface 11. Surface 11 deflects under the weight of the storage units 16 to a deflected position, shown at 30. Due to the deflection of the surface 26 and correspondingly of the rails 14 mounted to the surface 26, each storage unit 16 tends to drift or move toward the lowermost point 31 of the deflected surface 30, each storage unit 16 tends to move or drift toward the lowermost deflected point 31 under the force of gravity, when motor 22 is not being operated to move the storage unit 16 on the rails 14. Such movement or drifting of the storage unit 16 is caused by rotation of the wheels 18 on the rails 14 and the ability of the drive shaft 20 to rotate relative to the motor 22 when motor 22 is not being operated.

In accordance with the present invention, to prevent the inadvertent movement or drifting of each storage unit 16 along the rails 14 to the lowermost point 31 of the deflected rails 14, the electric motor 22 is also operably connected to a motor brake 32. The brake 32 is mounted to the motor 22 generally at the end of motor 22 opposite the motor bracket 28, and is engaged with the motor output shaft 25. In the illustrated embodiment, the motor brake 32 includes a recess 33 into which the end of motor output shaft 25 extends. Alternatively, the motor brake 32 may be positioned so as to act on the drive shaft 20 or the axle 39. The motor brake 32 may be any satisfactory shaft brake, and representatively may be a Power Off type brake such as is available from Inertia Dynamics of Torrington, Connecticut under its model number 1702-2521. It is understood, however, that any other type of satisfactory shaft brake may be employed.

Referring to FIG. 2, in order to enable the motor 20 and motor brake 32 to be operated in concert with one another, the motor brake 32 is connected via suitable connectors or wires 34 and 38 to a motor brake and status board 36, which can send control signals to operate the brake 32 and also receive an electronic indication of the status of the brake 32. The status board 36 is also operably connected to a main control board 40, from which control signals for the operation of the motor 22 can be sent to the motor 22 in response to user operation of the control panel 24 on the storage unit 16.

In operation, when an individual utilizes the control panel 24 to move a specific storage unit 16, the control board 40 of the specified storage unit 16 sends a signal to the electric motor 22, and to the status board 36 connected to the motor brake 32. This signal, which can be a power signal, causes the electric motor 22 to operate and cause the rotation of the axle 39 and shaft 20 to move the unit 16 in a specified direction. Simultaneously, a signal, such as power signal, is sent to the motor brake 32 from the status board 36 in order to disengage the brake 32 from the shaft 20 through the various drive components, or maintain the brake 32 in a disengaged position, such that the shaft 20 is free to rotate in conjunction with the electric motor 22. Once the unit 16 is positioned where desired, the operator depresses or releases a stop switch (not shown) on the control panel 24. This generates a stop signal that is sent from the control panel 24 to the control board 40, which in turn sends terminates the power signal to the motor 22 to cease operation of the motor 22. Simultaneously, the power signal sent from the control board 40 through the motor brake and status board 36 to the motor brake 32 is terminated, causing the brake 32 to engage the motor shaft 25, and the shaft 20 through the various drive components, and prevent any further rotation of the shaft 20, for maintaining the unit 16 at the specified location.

Figure 5:
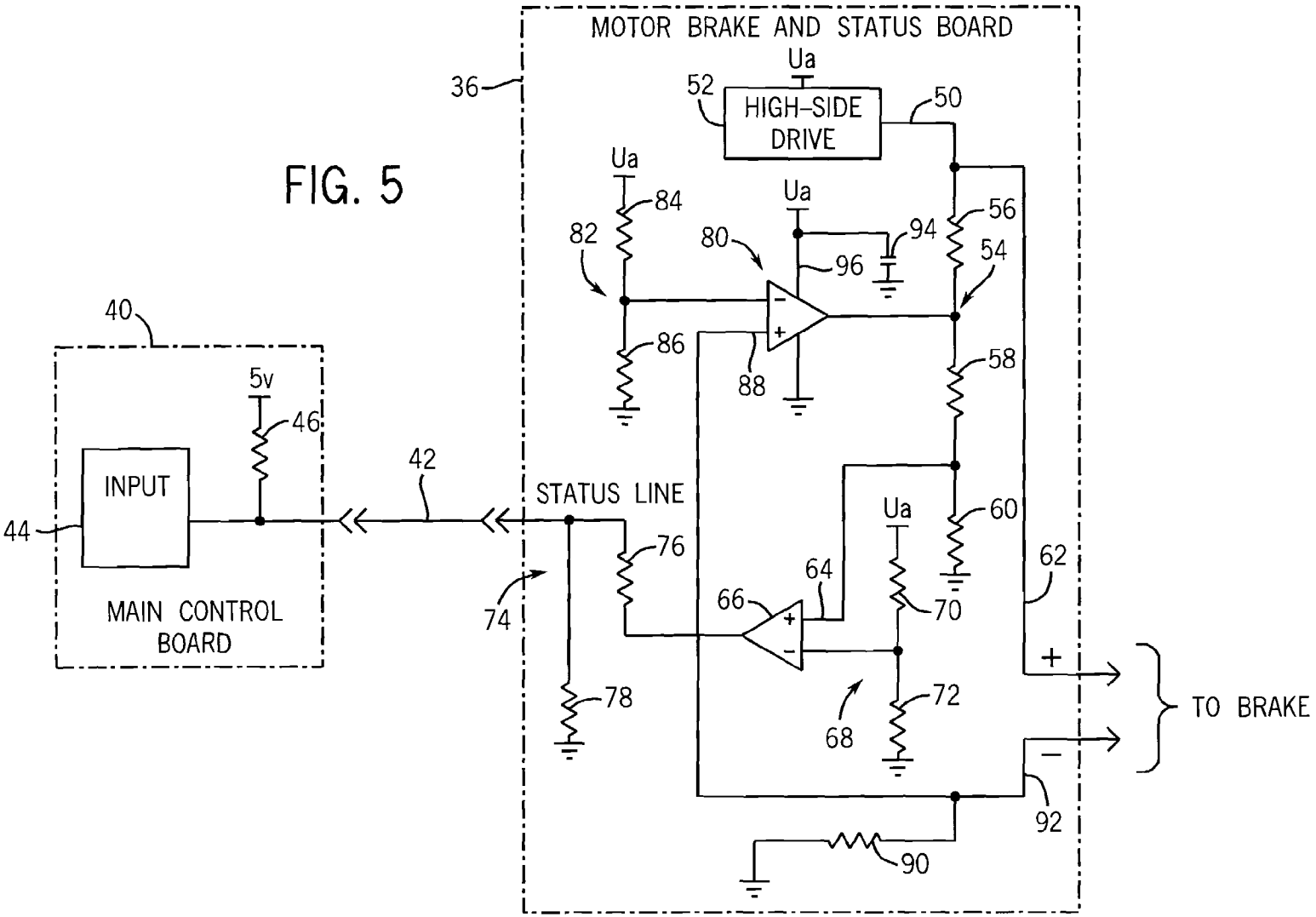
FIG. 5 is a schematic circuit diagram of the main control board and the motor brake and status board shown in FIG. 2.

Looking now at FIG. 5, a circuit diagram of the main control board 40, the motor brake and status board 36, the motor brake 32, and the connections between them is illustrated. There is a multi-wire connection (not shown) between the main control board 40 and the motor brake and status board 36, but only a single wire forms the single status line 42 functions to enable signals from the status board 36 concerning the connection of the status board 36 to the main board 40, and of the connection of the board 36 to a load, via the brake 32. The connection between the motor and brake status board 36 and the motor brake 32 is formed with a pair of wires 34 and 38. These wires 34 and 38 provide the source and the return signals from the status board 36 to control the operation of the brake 32 that enables the holding brake 32 and status board 36 to prevent the storage unit 16 from drifting along the rails 14.

The main control board 40 includes a digital or analog input 44 that is pulled-up to 5V through a resistor 46. Both the input 44 and the resistor 46 are located on the main control board 40 that is connected to the motor brake and status board 36 through the single status line 42. On the motor brake and status board 36, an output 50 of a high side drive 52 is connected to a resistor-ladder 54 including resistors 56, 58 and 60, as well as to the motor brake sourcing output 62. The resistor ladder 54 scales the voltage coming from the high side drive 52 to the positive input 64 of an op-amp 66. A second resistor ladder 68 includes resistors 70 and 72 and provides the switching threshold for the op-amp 66. A resistor divider 74, including resistors 76 and 78, scales the voltage out of the op-amp 66 to be a "high" (3.5V-5.5V) or lower. The resistor 78 of the divider 74 also pulls down the voltage from resistor 46 to a "low" when the divider 74, and thus the status board 36, is connected to the main control board 40. A second op-amp 80 uses a third resistor ladder 82 including resistors 84 and 86 for the switching threshold of the op-amp 80. The positive input 88 of the op-amp 80 is connected between a resistor 90 and the motor brake return output 92. Also, a capacitor 94 is connected to the op-amp 80 at the power input 96 to help provide some noise filtering. The supply voltage Ua for the motor brake and status board 36 is variable, and preferably between 18V-25V.

In operation, the electronic circuit of the motor brake and status board 36 provides a status signal along the single status line 42 to the main control board 40 of whether or not the circuit is connected to the main control board 40, and also whether or not a load is connected to the high side drive 52 via the brake 32. More specifically, if the motor brake and status board 36 are not connected to the main control board 40, and the load is or is not connected to the motor brake and status board 36, a "high" (high=3.5 Volts-5.5 Volts) will always be seen on the status line 42 when the high side drive 52 is in either the on or off state. Further, if the motor brake and status board 36 is connected to the main control board 40 and the load is not connected to the high side drive 52, a "low" (low=less than 0.5 Volts) will always be seen on the status line 42 when the high side drive 52 is in either the on or off state. If the motor brake and status board 36 is connected to the main control board 40 and the load is connected to the high side drive 52, a "low" will be seen on the status line 42 if the high side drive 52 is in the off state. In this case a "high" will only be seen on the status line 42 if the high side drive 52 is on and the load is being driven at a defined minimum current or greater (about 90 mA-125 mA or greater), barring any fault conditions.

Fault conditions can also be determined using the status line 42 and the commanded state of the high side driver 52. For example, a short to Ua (STUa) with the proper load connected to the high side drive 52 looks to the main control board 40 like the control board 40 is not connected to the motor brake and status board 36. Further, a STUa with the load not connected to the high side drive 52 looks to the main control board 40 like an open load. Also, a short to ground (STG) with or without the load connected to the high side drive 52 looks like an open load. Table 1 shows an exhaustive listing of the states aforementioned.

TABLE 1

Brake Status States

Motor Brake Control Board not connected to Main Control Board and/or STUa w/ load connected
Motor Brake and Status Board has Open Load and/or STG w/ or w/o load connected and/or STUa w/o load connected

| Condition # | Main Control Board Connected? | Load Connected? | FIG. 3, Item 92 | FIG. 3, Item 62 | High-Side Drive State | Status Line |
|---|---|---|---|---|---|---|
| 1 | NO | X | X | X | OFF | HIGH |
| 2 | NO | X | X | X | ON | HIGH |
| 3 | YES | YES | NORMAL | NORMAL | ON | HIGH |
| 4 | YES | YES | NORMAL | NORMAL | OFF | LOW |
| 5 | YES | NO | NORMAL | NORMAL | ON | LOW |
| 6 | YES | NO | NORMAL | NORMAL | OFF | LOW |
| 7 | YES | YES | NORMAL | STUa | ON | HIGH |
| 8 | YES | YES | NORMAL | STUa | OFF | HIGH |
| 9 | YES | NO | NORMAL | STUa | ON | LOW |
| 10 | YES | NO | NORMAL | STUa | OFF | LOW |
| 11 | YES | YES | STUa | NORMAL | ON | HIGH |
| 12 | YES | YES | STUa | NORMAL | OFF | HIGH |
| 13 | YES | NO | STUa | NORMAL | ON | LOW |
| 14 | YES | NO | STUa | NORMAL | OFF | LOW |
| 15 | YES | YES | NORMAL | STG | ON | LOW |
| 16 | YES | YES | NORMAL | STG | OFF | LOW |
| 17 | YES | NO | NORMAL | STG | ON | LOW |
| 18 | YES | NO | NORMAL | STG | OFF | LOW |
| 19 | YES | YES | STG | NORMAL | ON | LOW |
| 20 | YES | YES | STG | NORMAL | OFF | LOW |
| 21 | YES | NO | STG | NORMAL | ON | LOW |
| 22 | YES | NO | STG | NORMAL | OFF | LOW |

Various alternatives are contemplated as being within the scope of the following claims particularly pointing out and distinctly claiming the subject matter regarded as the invention.

We claim:

1. A mobile storage unit comprising:

a) a housing adapted to receive and retain items therein;

b) a shaft rotatably secured to the housing;

c) at least one wheel interconnected with the shaft for rotation therewith;

d) an electric motor operably connected to the shaft to rotate the shaft; and e) a motor brake operably connected to the shaft, wherein the motor brake is operably connected to a motor brake and status controller, and wherein the motor brake and status controller is operably connected to a main controller via a single status line.

2. The storage unit of claim 1 wherein the motor brake is connected to the electric motor.

3. The storage unit of claim 1 wherein the motor brake defines a recess therein within which the shaft is received.

4. The storage unit of claim 3 wherein the recess is positioned in alignment with a central opening extending through the electric motor in which the shaft is positioned.

5. The storage unit of claim 1 wherein the motor brake and status controller is configured to provide status signals to the main controller along the single status line concerning the connection of the motor brake and status controller to a load and to the main controller.

6. The storage unit of claim 1 wherein the motor brake is deactivated when a power supply is connected to the motor brake.

7. The storage unit of claim 1 wherein the motor brake is activated when a power supply is disconnected from the motor brake.

8. A method for controlling the movement of a mobile storage unit in a mobile storage unit system, the method comprising the steps of:

a) providing a storage unit including a housing adapted to receive and retain items therein, a shaft rotatably secured to the housing, at least one wheel secured to the shaft for rotation therewith, an electric motor operably connected to the shaft to rotate the shaft, and a motor brake operably connected to the shaft;

b) connecting a power supply to the motor brake to allow rotation of the shaft; and c) providing a status signal from a motor brake and status controller to a main controller along a single status line connecting the motor brake and status controller to the main controller after connecting the power supply.

9. The method of claim 8 further comprising the step of connecting the power supply to the electric motor to rotate the shaft simultaneously with connecting the power supply to the motor brake.

10. The method of claim 8 further comprising the step of disconnecting the power supply to the motor brake to prevent rotation of the shaft after connecting the power supply to the shaft.

11. The method of claim 10 further comprising the step of disconnecting the power supply from the electric motor simultaneously with disconnecting the power supply from the motor brake.

12. The method of claim 8 wherein the step of providing the status signal comprises:

a) sending a signal concerning the status of a load connection to the motor brake and status controller along the single status line; and b) sending a signal concerning the status of a connection between the motor brake and status controller and the main controller.

13. The method of claim 8 further comprising the step of altering the connection of the power supply to the motor brake in response to the signal sent from the motor brake and status controller to the main controller along the single status line.

* * * * *

UNITED STATES PATENT AND TRADEMARK OFFICE

CERTIFICATE OF CORRECTION

PATENT NO. : 7,583,037 B2
APPLICATION NO. : 11/426150
DATED : September 1, 2009
INVENTOR(S) : Bourke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 426 days.

Signed and Sealed this

Fourteenth Day of September, 2010

David J. Kappos

David J. Kappos
*Director of the United States Patent and Trademark Office*